US008096551B2

(12) United States Patent
Wakana

(10) Patent No.: US 8,096,551 B2
(45) Date of Patent: Jan. 17, 2012

(54) MEDIUM TRANSPORTATION APPARATUS AND IMAGE FORMING APPARATUS HAVING PLANETARY GEAR ROTATIONAL LOAD MEMBER

(75) Inventor: Takashi Wakana, Tokyo (JP)

(73) Assignee: Oki Data Corporation, Tokyo (JP)

( * ) Notice: Subject to any disclaimer, the term of this patent is extended or adjusted under 35 U.S.C. 154(b) by 159 days.

(21) Appl. No.: 12/382,956

(22) Filed: Mar. 27, 2009

(65) Prior Publication Data

US 2009/0325752 A1 Dec. 31, 2009

(30) Foreign Application Priority Data

Jun. 26, 2008 (JP) ..... 2008-166857

(51) Int. Cl.
*B65H 5/00* (2006.01)

(52) U.S. Cl. ..... 271/264; 74/52

(58) Field of Classification Search ..... 271/264; 74/52

See application file for complete search history.

(56) References Cited

U.S. PATENT DOCUMENTS 5,213,426 A * 5/1993 Ewing ..... 271/126

FOREIGN PATENT DOCUMENTS

| | | | |
|---|---|---|---|
| JP | 04-058535 U | | 5/1992 |
| JP | 04058535 U | * | 5/1992 |
| JP | 06263273 A | * | 9/1994 |
| JP | 09-216747 | | 8/1997 |
| JP | 09216747 A | * | 8/1997 |
| JP | 11155042 A | * | 6/1999 |
| JP | 2005-212999 | | 8/2005 |

* cited by examiner

*Primary Examiner* — Gerald McClain
(74) *Attorney, Agent, or Firm* — Kubotera & Associates, LLC

(57) ABSTRACT

A medium transportation apparatus is provided with a plurality of medium transportation units, a drive source, a sun gear connected to the drive source, a planetary gear engaging the sun gear for transmitting a drive force to one of the medium transportation units according to a rotational direction of the sun gear, and a rotational load member for applying a rotational load to the planetary gear. The rotational load member is disposed on an outer side relative to a rotational shaft of the planetary gear in a radial direction of a rotational shaft of the sun gear.

18 Claims, 11 Drawing Sheets

MEDIUM TRANSPORTATION APPARATUS AND IMAGE FORMING APPARATUS HAVING PLANETARY GEAR ROTATIONAL LOAD MEMBER

The disclosure of Japanese Patent Application No. 2008-166857, filed on Jun. 26, 2008, is incorporated in the application by reference.

BACKGROUND OF THE INVENTION AND RELATED ART STATEMENT

The present invention relates to a medium transportation apparatus and an image forming apparatus having the medium transportation apparatus.

Conventionally, an image forming apparatus such as a printer, a copier, a facsimile, and the likes is provided with a medium transportation apparatus for transporting a recording medium to an image forming unit. The medium transportation apparatus may be configured to switch between one mechanism (a medium transportation mechanism) for picking up a plurality of media retained in a medium tray one by one and transporting the medium to the image forming unit and another mechanism (an MPT transportation mechanism) for picking up a plurality of media retained in an MPT (Multi Purpose Tray) one by one and transporting the medium to the image forming unit (refer to Patent Reference). Patent Reference: Japanese Patent Publication No. 2005-212999

FIG. 6(A) is a schematic view showing a configuration of a conventional medium transportation apparatus. As shown in FIG. 6(A), the conventional medium transportation apparatus includes a drive source gear 53 for transmitting a drive force from a drive source (not shown); an idle gear 54 engaging the drive source gear 53; a sun gear 55 engaging the idle gear 54 and a planetary gear 56; the planetary gear 56 for transmitting the drive force from the sun gear 55 to one of a register roller gear 60 and an idle gear 57 of a medium transportation mechanism through engaging therewith according to a rotational direction of the sun gear 55; a reduction gear 58 engaging the idle gear 57; an MPT sheet supply roller gear 59 engaging the reduction gear 58; a register roller 75; and an MPT sheet supply roller 77. A recording medium is represented with a hidden line in FIG. 6(A).

FIG. 6(B) is a schematic perspective view showing a configuration surrounding the planetary gear 56 of the conventional medium transportation apparatus. As shown in FIG. 6(B), in addition to the components shown in FIG. 6(A), the conventional medium transportation apparatus includes a pressing plate member 62 disposed in the planetary gear 56; a compression spring 61 disposed between the planetary gear 56 and the pressing plate member 62 for pushing the pressing plate member 62 outwardly; brackets 63 for holding the planetary gear 56; and guide holes 64 formed in the brackets 63 for guiding a rotational shaft of the planetary gear 56.

In FIG. 6(A), when the drive source gear 53 rotates in the right direction, the sun gear 55 rotates in the right direction through the idle gear 54, thereby transmitting the drive force of the left rotation to the planetary gear 56. At this moment, the compression spring 61 pushes the pressing plate member 62 disposed in the planetary gear 56 against the bracket 63, thereby causing a frictional force therebetween. Accordingly, the rotational shaft of the planetary gear 56 moves in the guide hole 64 in the right direction.

When the rotational shaft of the planetary gear 56 moves in the guide hole 64 in the right direction, the planetary gear 56 engages the idle gear 57. Accordingly, the drive force transmitted from the drive source gear 53 is transmitted to the MPT sheet supply gear 59 through the idle gear 54, the sun gear 55, the planetary gear 56, the idle gear 57, and the reduction gear 58, thereby rotating the MPT sheet supply roller 77. As a result, the recording medium retained in the MPT is separated and transported one by one.

When the drive source gear 53 rotates in the left direction, the sun gear 55 rotates in the left direction through the idle gear 54, thereby transmitting the drive force of the right rotation to the planetary gear 56. At this moment, the rotational shaft of the planetary gear 56 moves in the guide hole 64 in the left direction. Accordingly, the planetary gear 56 engages the register roller gear 60. As a result, the drive force transmitted from the drive source gear 53 is transmitted to the register roller gear 60 through the idle gear 54, the sun gear 55, and the planetary gear 56, thereby rotating the register roller 60. Accordingly, the recording medium is transported to the image forming unit.

As shown in FIG. 6(A), the compression spring 61 pushes the pressing plate member 62 disposed in the planetary gear 56 against the brackets 63, thereby generating pressing forces Pa' and Pb'. Accordingly, frictional forces Fa' and Fb', i.e., products of the pressing forces Pa' and Pb' and coefficients of friction $\mu a'$ and $\mu b'$, respectively, are generated at points A' and B', respectively. As a result, when the sun gear 55 rotates, the rotational shaft of the planetary gear 56 moves in the guide hole 64.

It is supposed that a distance between an engagement point between the planetary gear 56 and the sun gear 55 to the point A' of the frictional force Fa' is La', and a distance between the engagement point to the point B' of the frictional force Fb' is Lb'. According to a moment relationship, when the frictional force Fb' is less than La'/Lb' times of the frictional force Fa' ($Fb' < La'/Lb' \times Fa'$), the rotational shaft of the planetary gear 56 moves in a direction of a force F' applied from the sun gear 55, thereby switching the gear engaging the planetary gear 56.

In the conventional medium transportation apparatus, the compression spring 61 tends to push the pressing plate member 62 at a larger force at an end portion thereof. Further, the pressing plate member 62 tends to deform. Accordingly, the pressing forces Pa' and Pb' tend to fluctuate. Further, the pressing plate member 62 does not abut against the bracket 63 at a constant location, rather various locations along a circle. Accordingly, when the planetary gear 56 switches the gear, the frictional forces Fa' and Fb' always vary.

According to the moment relationship around the rotational shaft of the planetary gear 56, when the frictional force Fb' becomes equal to La'/Lb' times of the frictional force Fa' ($Fb' = La'/Lb' \times Fa'$), the planetary gear 56 stops rotating, thereby making it difficult to switch the gear. Further, when the frictional force Fb' becomes greater than La'/Lb' times of the frictional force Fa' ($Fb' > La'/Lb' \times Fa'$), the rotational shaft of the planetary gear 56 moves in a direction opposite to the direction of the force F' applied from the sun gear 55. As a result, the planetary gear 56 switches the gear at various timings or a delayed timing, and it is difficult to sufficiently switch the gear.

In view of the problems described above, an object of the present invention is to provide a medium transportation apparatus and an image reading apparatus having the medium transportation apparatus, in which a planetary gear stably moves in a direction of a force applied from a sun gear even when a frictional force or a reaction force varies.

Further objects and advantages of the invention will be apparent from the following description of the invention.

SUMMARY OF THE INVENTION

In order to attain the objects described above, according to a first aspect of the present invention, a medium transportation apparatus is provided with a plurality of medium transportation units; a drive source; a sun gear connected to the drive source; a planetary gear engaging the sun gear for transmitting a drive force to one of the medium transportation units according to a rotational direction of the sun gear; and a rotational load member for applying a rotational load to the planetary gear. The rotational load member is disposed on an outer side relative to a rotational shaft of the planetary gear in a radial direction of a rotational shaft of the sun gear.

According to a second aspect of the present invention, an image forming apparatus is provided with a plurality of medium transportation units; a drive source; a sun gear connected to the drive source; a planetary gear engaging the sun gear for transmitting a drive force to one of the medium transportation units according to a rotational direction of the sun gear; and a rotational load member for applying a rotational load to the planetary gear. The rotational load member is disposed on an outer side relative to a rotational shaft of the planetary gear in a radial direction of a rotational shaft of the sun gear.

In the first aspect of the present invention, the medium transportation apparatus includes the rotational load member disposed on the outer side relative to the rotational shaft of the planetary gear in the radial direction of the rotational shaft of the sun gear. Accordingly, it is possible to stably move the planetary gear in a direction of a force applied from the sun gear even when a frictional force or a reaction force varies.

DETAILED DESCRIPTION OF THE PREFERRED EMBODIMENTS

Hereunder, embodiments of the present invention will be explained with reference to the accompanying drawings.

First Embodiment

Figure 1:
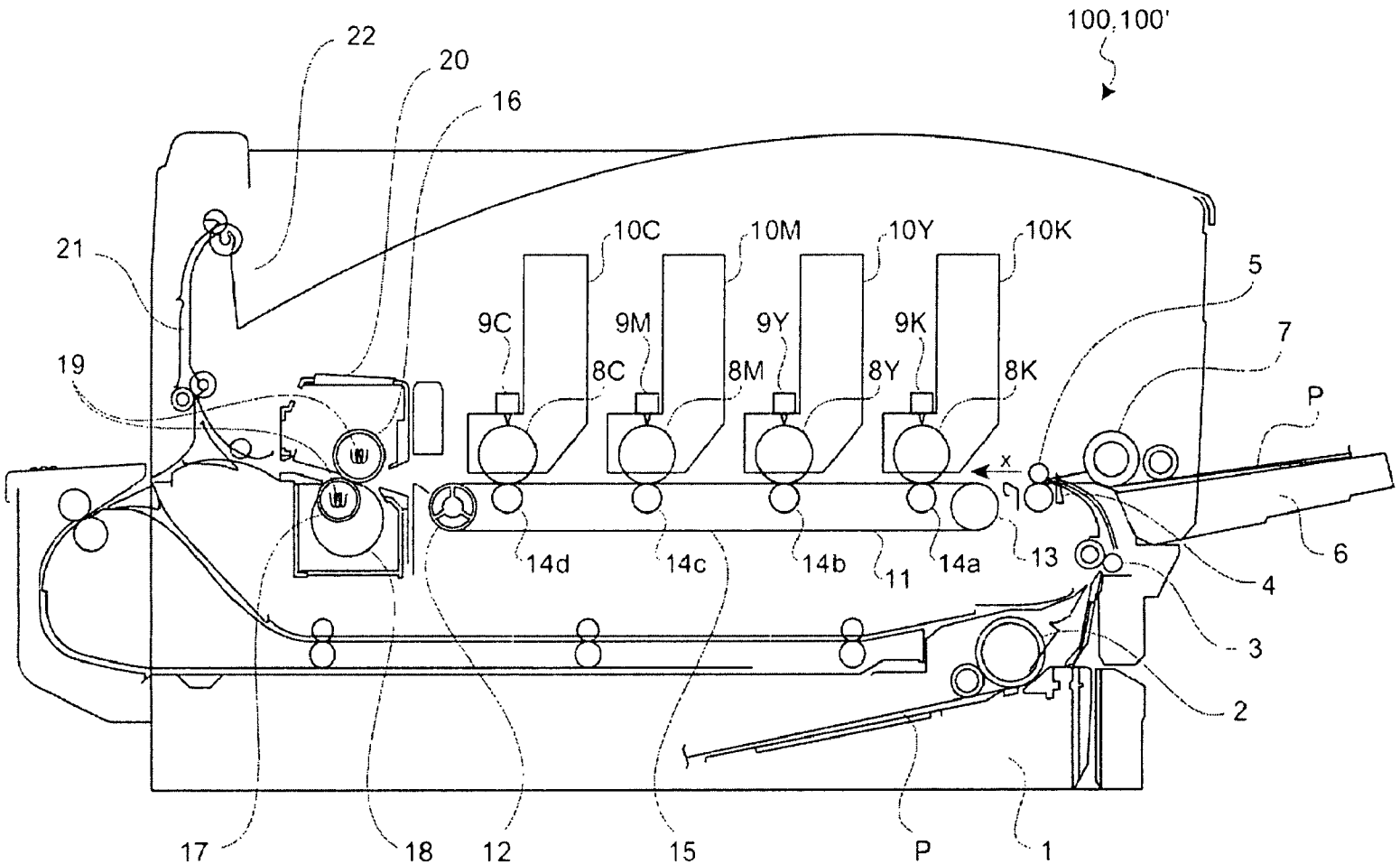
FIG. 1 is a schematic sectional view showing a printer according to a first embodiment of the present invention.

A first embodiment of the present invention will be explained. FIG. 1 is a schematic sectional view showing a printer 100 as an image forming apparatus according to the first embodiment of the present invention. In the following description, the printer 100 provided with a medium transportation apparatus will be explained first, and then the medium transportation apparatus will be explained next. In the first embodiment, the printer 100 is a printer of, for example, an electro-photography type capable of forming an image on a recording medium according to print data input thereto.

As shown in FIG. 1, the printer 100 includes a sheet transportation path having a substantially S character shape. The sheet transportation path extends from a medium cassette 1 for retaining a sheet P or a recording medium as a starting point to a medium stacker 22 as an ending point through a sheet supply roller 2, a feed roller 3, a register sensor 4, a register roller 5, a transfer unit 15, a fixing unit 20, and a medium discharge unit 21.

In the embodiment, an MPT sheet supply roller 7 is disposed near the register roller 5 arranged at a middle portion of the medium transportation path for transporting the sheet P retained in an MPT tray 6 in an arrow direction x. The register roller 5 and the MPT sheet supply roller 7 constitute medium transportation units (described later). Developing units 10 (10K, 10Y, 10M, and 10C) corresponding to four colors (black (K), yellow (Y), magenta (M), and cyan (C)) are disposed above the transfer unit 15 to be detachable relative to the printer 100.

Each of the components described above will be explained next. The medium cassette 1 retains the sheet P in a stacked state therein, and is detachably disposed at a lower portion of the printer 100. The sheet supply roller 2 is disposed at an upper portion of the medium cassette 1 for separating and picking up the sheet P one by one. A drive source (not shown) drives the sheet supply roller 2 to rotate for transporting the sheet P picked up from the medium cassette 1 to the feed roller 3.

In the embodiment, the feed roller 3 corrects skew of the sheet P. A drive source (not shown) drives the feed roller 3 to rotate for transporting the sheet P to the register roller 5. The register sensor 4 detects a leading edge of the sheet P, and sends a detection result to a print control unit (not shown). The register sensor 4 is formed of, not limited to, a photo interceptor of a light transmission type or a light reflection type.

In the embodiment, the register roller 5 transports the sheet P transported with the feed roller 3 or the MPT sheet supply roller 7 to the developing units 10. When a long sheet or a non-bendable sheet is printed manually, the sheet P is placed on the MPT tray 6. The MPT sheet supply roller 7 transports the sheet P placed on the MPT tray 6 to the developing units 10 in the arrow direction x. The register roller 5 and the MPT sheet supply roller 7 constitute the medium transportation units. A drive force transmitted from a drive source gear 23 (described later) drives the register roller 5 and the MPT sheet supply roller 7 to rotate for transporting the sheet P to the developing units 10.

In the embodiment, the developing units 10 (10K, 10Y, 10M, and 10C) use toner in difference colors and have an identical configuration. In the following description, the developing unit 10K for forming a toner image in black will be explained.

In the embodiment, the developing unit 10K includes a photosensitive drum 8K for forming a toner image on a surface thereof and an LED (Light Emitting Diode) array unit 9K for irradiating the surface of the photosensitive drum 8K according to print data input thereto to form a static latent image. The photosensitive drum 8K is formed of a conductive supporting member and a photo conductive layer. The conductive supporting member may be formed of a metal pipe such as an aluminum pipe. The photo conductive layer may be formed of an organic photosensitive member including a charge generation layer and a charge transport layer laminated alternately.

In the embodiment, a charging roller (not shown) uniformly charges the surface of the photosensitive drum 8K, and the LED array unit 9K irradiates the surface of the photosensitive drum 8K to form the static latent image thereon. The LED array unit 9K is formed of an LED light emitting element and a lens array, and irradiates the surface of the photosensitive drum 8K according to the print data to form the static latent image corresponding to an image in black. In addition to the components described above, the developing unit 10K further includes a developing roller (not shown) for supplying toner in black to the static latent image formed on the surface of the photosensitive drum 8K to reversely develop the static latent image for forming the toner image, and a toner supply roller for supplying toner in black to the developing roller (not shown).

In the embodiment, the transfer unit 15 includes a transfer belt 11 for statically attaching and transporting the sheet P; a drive roller 12 and an idle roller 13 for extending the transfer belt 11; and transfer rollers 14 (14*a*, 14*b*, 14*c*, and 14*d*) for transferring the toner images formed on the surfaces of the photosensitive drums 8 to the sheet P. The transfer belt 11 has an endless shape, and is formed of a semi-conductive plastic film with a high resistivity having a gloss surface. The transfer belt 11 statically attaches and transports the sheet P along the sheet transportation path.

In the embodiment, a drive source (not shown) drives the drive roller 12 to rotate for driving the transfer belt 11. The idle roller 13 is paired with the drive roller 12 to extend the transfer belt 11, and rotates together with the drive roller 12 to drive the transfer belt 11. The transfer rollers 14 (14*a*, 14*b*, 14*c*, and 14*d*) are arranged to abut against the photosensitive drums 8 (8K, 8Y, 8M, and 8C) through the transfer belt 11. A transfer power source (not shown) applies a bias voltage to the transfer rollers 14 (14*a*, 14*b*, 14*c*, and 14*d*) to transfer the toner images formed on the surfaces of the photosensitive drums 8 (8K, 8Y, 8M, and 8C) to the sheet P at a specific timing.

In the embodiment, the fixing unit 20 includes a heat roller 16; a backup roller 17; a fixing belt 18 winding around the backup roller 17; and halogen lamps 19 disposed in the heat roller 16 and the backup roller 17. A temperature control unit (not shown) controls the halogen lamps 19 to turn on and off, thereby maintaining the fixing unit 20 at a specific temperature. When the sheet P passes through a nip portion between the heat roller 16 and the fixing belt 18, the fixing unit 20 applies heat and pressure to the sheet P, thereby fixing the toner image.

In the embodiment, the medium discharge unit 21 includes a plurality of roller pairs and a guide member for sandwiching and transporting the sheet P, so that the sheet P is discharged to the medium stacker 22 after the sheet P passes through the fixing unit 20. The medium stacker 22 is formed of an outer surface of a housing of the printer 100, and retains the sheet P discharged with the medium discharge unit 21.

In addition to the components described above, the printer 100 includes the print control unit having a micro-processor, ROM (Read Only Memory), RAM (Random Access Memory), an input/output port, a timer, and the likes; an interface control unit for receiving the print data and a control command to control an entire sequence of the printer 100 for performing a printing operation; a display unit having a display device such as LCD (Liquid Crystal Display); an operation unit having an input device such as a touch panel for inputting an instruction of a user; various sensors such as a temperature/humidity sensor and a density sensor for monitoring an operational state of the printer 100; a head drive control unit for controlling drive of the LED array unit 9; a temperature control unit for controlling a temperature of the fixing unit 20; a sheet transportation motor control unit for controlling a drive motor as a drive source for rotating the rollers to transport the sheet P; a drive control unit for controlling a drive motor for rotating the photosensitive drums 8; and various power source for applying voltages to the rollers.

Figure 2A:
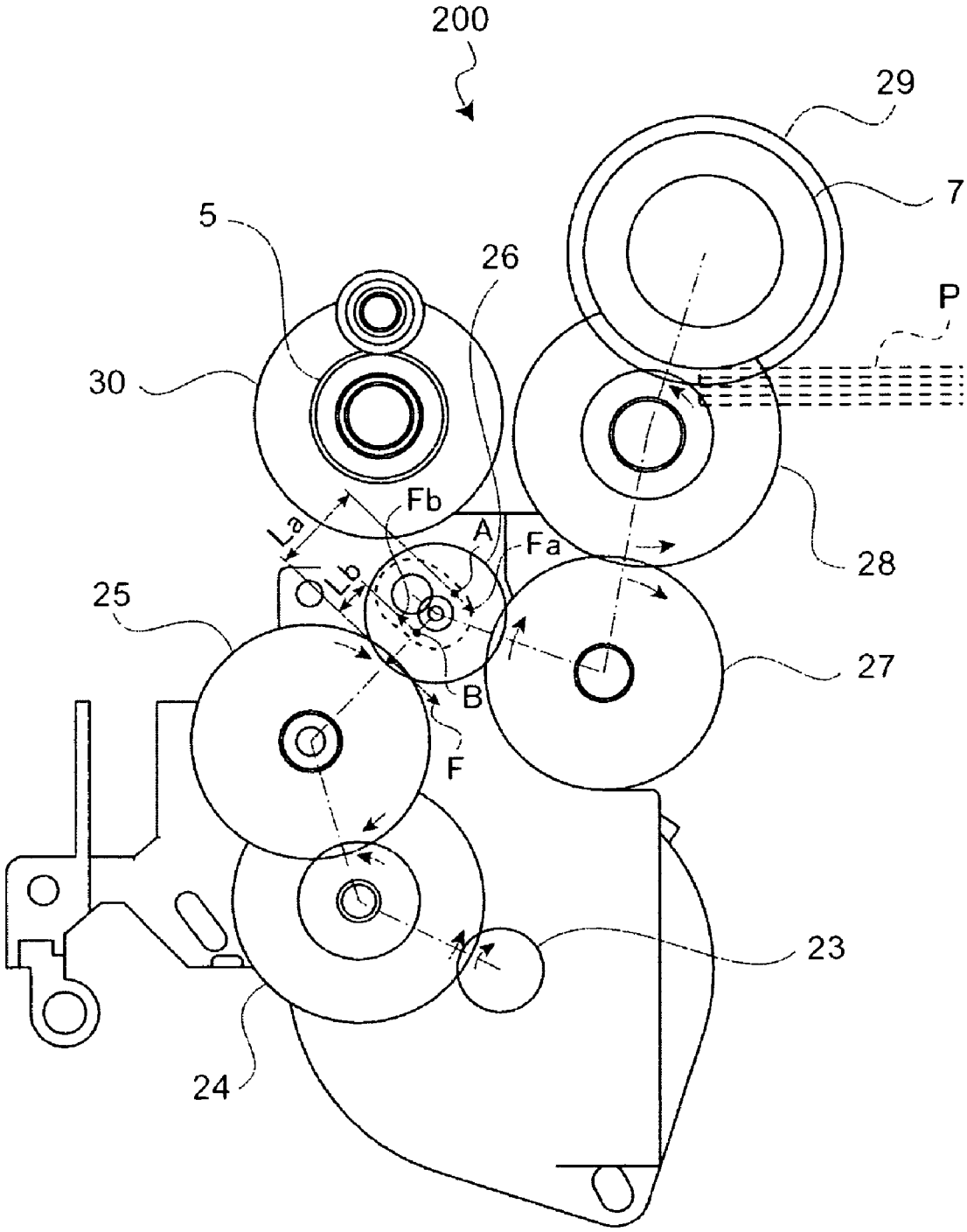
FIG. 2(A) is a schematic view showing a drive mechanism of the printer functioning as an MPT (Multi Purpose Tray) transportation mechanism according to the first embodiment of the present invention.
Figure 2B:
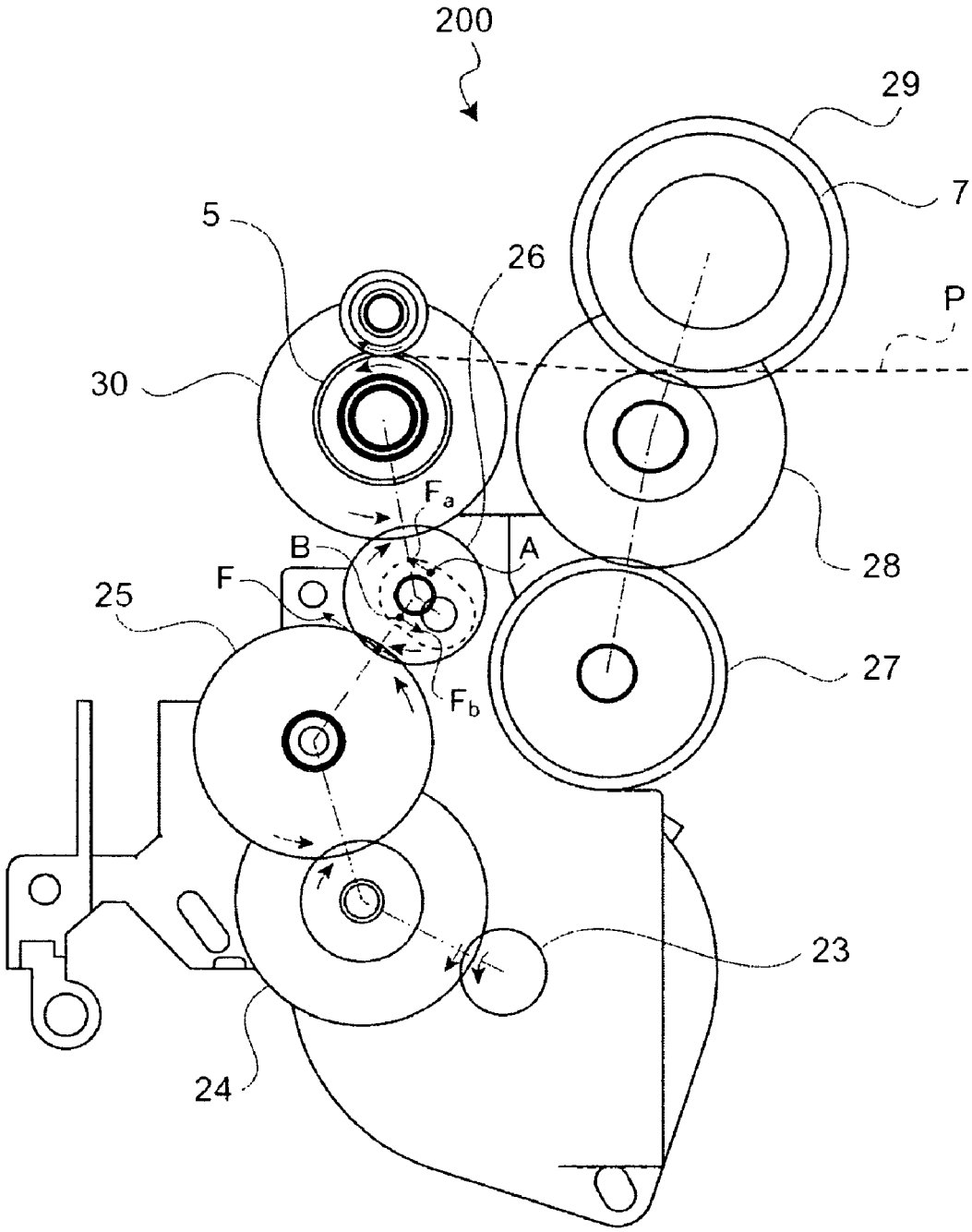
FIG. 2(B) is a schematic view showing the drive mechanism of the printer functioning as a medium transportation mechanism according to the first embodiment of the present invention.

The medium transportation apparatus will be explained next in more detail. FIG. 2(A) is a schematic view showing a drive mechanism 200 of the printer 100 functioning as an MPT (Multi Purpose Tray) transportation mechanism, in which the MPT sheet supply roller 7 transports the sheet P, according to the first embodiment of the present invention. FIG. 2(B) is a schematic view showing the drive mechanism 200 of the printer 100 functioning as a medium transportation mechanism, in which the register roller 5 transports the sheet P, according to the first embodiment of the present invention.

As shown in FIGS. 2(A) and 2(B), the drive mechanism 200 includes a drive source gear 23 for transmitting a drive force from a drive source (not shown); a reduction gear 24 engaging the drive source gear 23; a sun gear 25 engaging the reduction gear 24 and a planetary gear 26; the planetary gear 26 engaging one of an idle gear 27 of the MPT transportation mechanism and a register roller gear 30 of the medium transportation mechanism according to a rotational direction of the sun gear 25 for transmitting the drive force from the sun gear 25; a reduction gear 28 engaging the idle gear 27; and an MPT sheet supply roller gear 29 engaging the reduction gear 28. The sheet P placed in the MPT tray 6 is represented with a hidden line in FIG. 2(A).

Figure 3A:
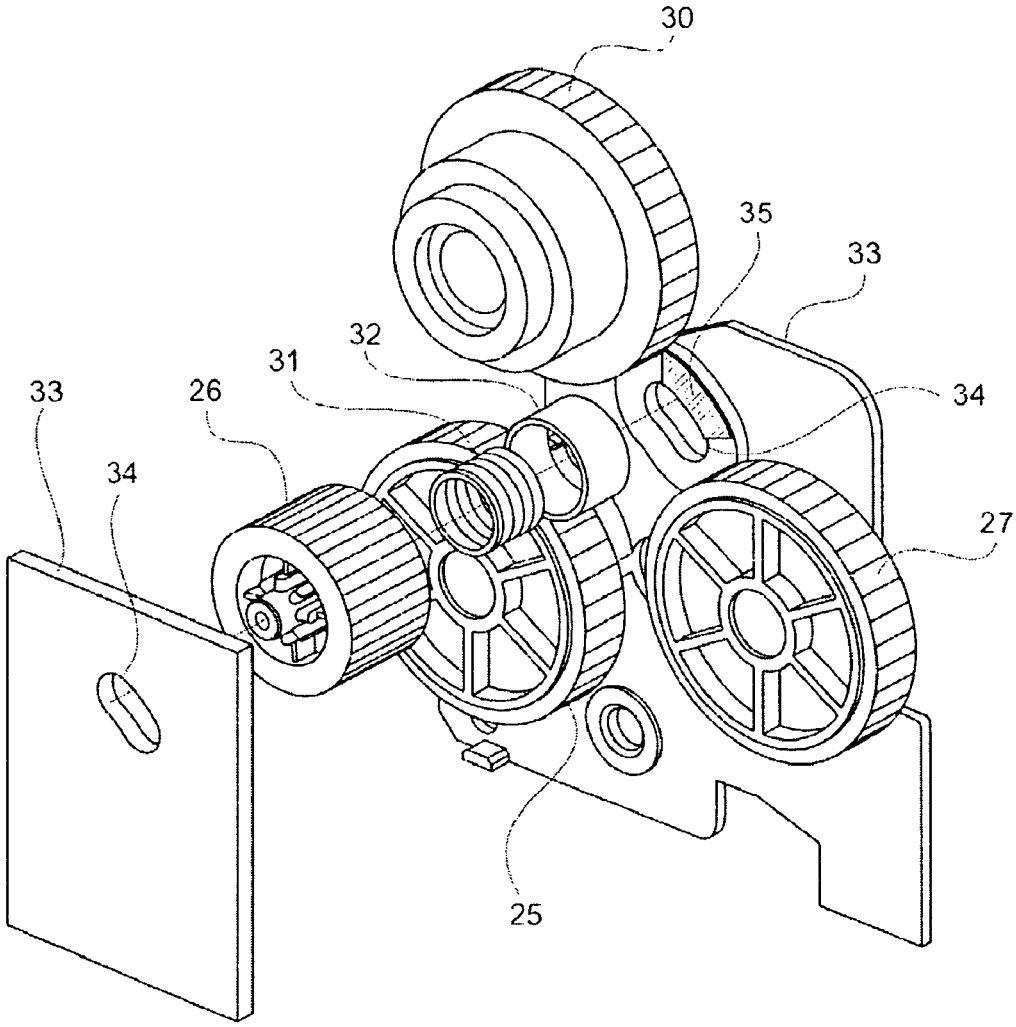
FIG. 3(A) is a schematic perspective view showing a configuration surrounding a planetary gear of the printer according to the first embodiment of the present invention.
Figure 3B:
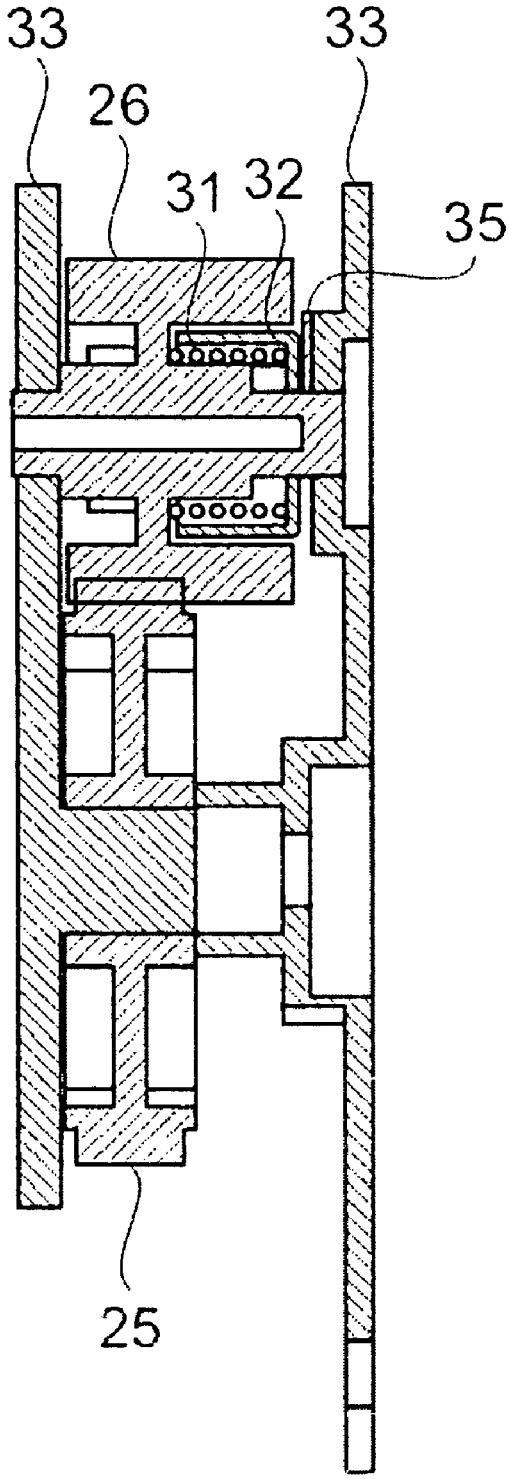
FIG. 3(B) is a schematic sectional view showing the configuration surrounding the planetary gear of the printer according to the first embodiment of the present invention.

FIG. 3(A) is a schematic perspective view showing a configuration surrounding the planetary gear 26 of the printer 100 according to the first embodiment of the present invention. FIG. 3(B) is a schematic sectional view showing the configuration surrounding the planetary gear 26 of the printer 100 according to the first embodiment of the present invention.

As shown in FIGS. 3(A) and 3(B), a pressing plate member 32 as a first rotational load member is disposed around a rotational shaft of the planetary gear 26 along a circumferential direction thereof. A compression spring 31 is disposed between the planetary gear 26 and the pressing plate member 32 for urging the pressing plate member 32 outwardly. Brackets 33 are arranged on both outsides of the planetary gear 26 and the pressing plate member 32, so that the brackets 33 sandwich the planetary gear 26 and the pressing plate member 32 with a specific distance therebetween.

In the embodiment, the compression spring 31 is disposed for urging the pressing plate member 32 outwardly. Accordingly, a reaction force of the brackets 33 is generated with respect to the pressing plate member 32 at abutting positions between the pressing plate member 32 and the bracket 33.

Further, each of the brackets 33 has a guide hole 34 with an arc shape for regulating a movement of the rotational shaft of the planetary gear 26. The guide holes 34 have a shape such that the planetary gear 26 engages the sun gear 25 and the idle gear 27 as shown in FIG. 2(A) when the rotational shaft of the planetary gear 26 moves to the right side. Further, the planetary gear 26 engages the sun gear 25 and the register roller gear 30 as shown in FIG. 2(B) when the rotational shaft of the planetary gear 26 moves to the left side.

In the embodiment, a protruding surface 35 as a second rotational load member is formed on one of the brackets 33 along a circumference of the guide hole 34. The protruding surface 35 is arranged to slide against the pressing plate member 32 of the planetary gear 26, and protrudes with a specific thickness outwardly relative to the rotational shaft of the planetary gear 26 in a radial direction of a rotational shaft of the sun gear 25. Accordingly, the brackets 33 sandwich the planetary gear 26 and the pressing plate member 32 with a distance smaller than the specific distance by a protruding amount of the protruding surface 35. The protruding amount of the protruding surface 35 may be set to 2% of the specific distance with which the brackets 33 sandwich the planetary gear 26 and the pressing plate member 32.

A printing operation of the printer 100 will be explained next. After a drive source (not shown) drives the sheet supply roller 2 to start rotating, the sheet supply roller 2 picks up the sheet P from the medium cassette 1 one by one. After the sheet supply roller 2 picks up the sheet P, the sheet P abuts against the feed roller 3 in a stationary state, so that the feed roller 3 warps the sheet P for a specific amount to correct skew thereof. After a drive source (not shown) drives the feed roller 3 to start rotating, the feed roller 3 transports the sheet P with skew thereof corrected to the register roller 5.

At this moment, the drive mechanism 200 has the arrangement shown in FIG. 2(B). More specifically, the drive source gear 23 rotates in the left direction, so that the sun gear 25 rotates in the left direction through the reduction gear 24 for transmitting a drive force of the right rotation to the planetary gear 26. At this moment, the rotational shaft of the planetary gear 26 moves in the guide holes 34 in the left direction. Accordingly, the planetary gear 26 engages the register roller gear 30, so that the drive force transmitted from the drive source gear 23 is transmitted through the reduction gear 24, the sun gear 25, the planetary gear 26, and the register roller gear 30 to rotate the register roller 5. When the register roller 5 starts rotating, the register roller 5 transports the sheet P transported from the feed roller 3 to the developing unit 10K.

In the next step, the LED array unit 9K irradiates the surface of the photosensitive drum 8K according to the print data at timing when the sheet P reaches the developing unit 10K, thereby forming the static latent image according to an image in black. The developing roller (not shown) attaches toner in black to the static latent image to inversely develop the static latent image, thereby forming the toner image in black.

When the sheet P reaches a nip portion between the photosensitive drum 8K and the transfer belt 11, the toner image in black on the photosensitive drum 8K is transferred to the sheet P through the bias voltage applied to the transfer roller 14*a*. Similarly, while the transfer belt 11 transports the sheet P, the toner images in other colors are sequentially transferred to the sheet P in the developing units 10Y, 10M, and 10C.

After the toner images are transferred to the sheet P, the sheet P is transported to the fixing unit 20. When the sheet P passes through the nip portion between the heat roller 16 and the fixing belt 18, the fixing unit 20 applies heat and pressure to the sheet P, thereby fixing the toner images to the sheet P. After the toner images are fixed to the sheet P, the medium discharge unit 21 discharges the sheet P to the medium stacker 22, thereby completing the printing operation.

When the sheet P is set in the MPT tray 6, and the MPT transportation mechanism transports the sheet P, the drive mechanism 200 has the arrangement shown in FIG. 2(A). In the arrangement, the drive source gear 23 rotates in the right direction, so that the sun gear 25 rotates in the right direction through the reduction gear 24 for transmitting a drive force of the left rotation to the planetary gear 26. More specifically, when the sun gear 25 rotates in the right direction, a force F is applied to a portion of the planetary gear 26 engaging the sun gear 25. As a reaction force, frictional forces Fa and Fb are generated at points A and B to become a rotational load of the planetary gear 26.

It is supposed that a distance between an engagement point between the planetary gear 26 and the sun gear 25 to the point A of the frictional force Fa is La, and a distance between the engagement point to the point B of the frictional force Fb is Lb. According to a moment relationship, when the following equation is satisfied, the rotational shaft of the planetary gear 26 moves a direction of the force F applied from the sun gear 25.

$$La \times Fa > Lb \times Fb \text{ or}$$

$$Fa > (Lb/La) \times Fb \quad (1)$$

The frictional force Fa is a product of a pressing force Pa of the compression spring 31 disposed in the planetary gear 26 at the point A and a coefficient of friction pa at the point A ($Fa = Pa \times \mu a$). Similarly, the frictional force Fb is a product of a pressing force Pb of the compression spring 31 disposed in the planetary gear 26 at the point B and a coefficient of friction $\mu b$ at the point B ($Fb = Pb \times \mu b$). Accordingly, the equation (1) can be modified to the equation (2) as follows:

$$Pa \times \mu a > (Lb/La) \times Pb \times \mu b$$

$$Pa > (Lb/La) \times (\mu b/\mu a) \times Pb \quad (2)$$

In the embodiment, the pressing plate member 32 is formed of a material the same as that of the protruding surface 35. Accordingly, the coefficient of friction $\mu a$ is equal to the coefficient of friction $\mu b$ ($\mu a = \mu b$). As a result, the equation (2) can be modified to the equation (3) as follows:

$$Pa > (Lb/La) \times Pb \quad (3)$$

Note that the pressing plate member 32 does not appear to contact with the protruding surface 35 at the point B in FIG. 3(B) for the presentation purpose. In an actual case, the compression spring 31 pushes the pressing plate member 32, so that the pressing plate member 32 contacts with the protruding surface 35 at the point B in an inclined state, thereby generating the frictional force Fb.

In the embodiment, as described above, the protruding surface 35 is formed on one of the brackets 33 along the circumference of the guide hole 34. The protruding surface 35 is arranged to slide against the pressing plate member 32 of the planetary gear 26, and protrudes with the specific thickness outwardly relative to the rotational shaft of the planetary gear 26 in the radial direction of the rotational shaft of the sun gear 25. Accordingly, the brackets 33 sandwich the planetary gear 26 and the pressing plate member 32 with the distance smaller than the specific distance by the protruding amount of the protruding surface 35. As a result, the pressing force Pa becomes greater than the pressing force Pb, thereby increasing a margin to satisfy the equation (3). Accordingly, it is possible to securely move the rotational shaft of the planetary gear 26 in the direction of the force F applied from the sun gear 25 while rotating in the left direction.

When the rotational shaft of the planetary gear 26 moves in the guide holes 34 in the right direction, the planetary gear 26 engages the idle gear 27, so that the drive force transmitted from the drive source gear 23 is transmitted through the reduction gear 24, the sun gear 25, the planetary gear 26, the idle gear 27, the reduction gear 28, and the MPT sheet supply roller gear 29 to rotate the MPT sheet supply roller 7. When the MPT sheet supply roller 7 starts rotating, the MPT sheet supply roller 7 picks up the sheet P placed in the MPT tray 6 one by one.

After the MPT sheet supply roller 7 picks up the sheet P, the register sensor 4 detects the sheet P, and the sheet P abuts against the register roller 5. After a specific period of time from when the register sensor 4 detects the sheet P, the drive source gear 23 of the drive mechanism 200 starts rotating in an opposite direction, i.e., the left direction. According to the moment relationship described above, the rotational shaft of the planetary gear 26 moves in the guide holes 34 in the left direction, i.e., from the idle gear 27 in the MPT transportation mechanism to the register roller gear 30 in the medium transportation mechanism.

When the planetary gear 26 engages the register roller gear 30, the drive force transmitted from the drive source gear 23 is transmitted through the reduction gear 24, the sun gear 25, the planetary gear 26, and the register roller gear 30 to rotate the register roller 5. When the register roller 5 starts rotating, the register roller 5 transports the sheet P transported from the feed roller 3 to the developing unit 10K. Afterward, the developing unit 10K performs the image forming process as described above.

As described above, in the embodiment, the protruding surface 35 is formed on one of the brackets 33 along the circumference of the guide hole 34. The protruding surface 35 is arranged to slide against the pressing plate member 32 of the planetary gear 26, and protrudes with the specific thickness outwardly relative to the rotational shaft of the planetary gear 26 in the radial direction of the rotational shaft of the sun gear 25. Accordingly, it is possible to increase only the pressing force Pa generated at the point A with the compression spring 31. As a result, even when the reaction force generated on the circumference of the compression spring 31 for generating the pressing forces Pa and Pb varies, it is possible to securely move the planetary gear 26 in the direction of the force F applied from the sun gear 25.

Second Embodiment

A second embodiment of the present invention will be explained next. In the second embodiment, a printer 100' has a configuration similar to that of the printer 100 in the first embodiment, and performs a printing operation similar to that of the printer 100 in the first embodiment. Accordingly, similar components are designated with the same reference numerals, and only differences from the first embodiment will be explained.

Figure 4A:
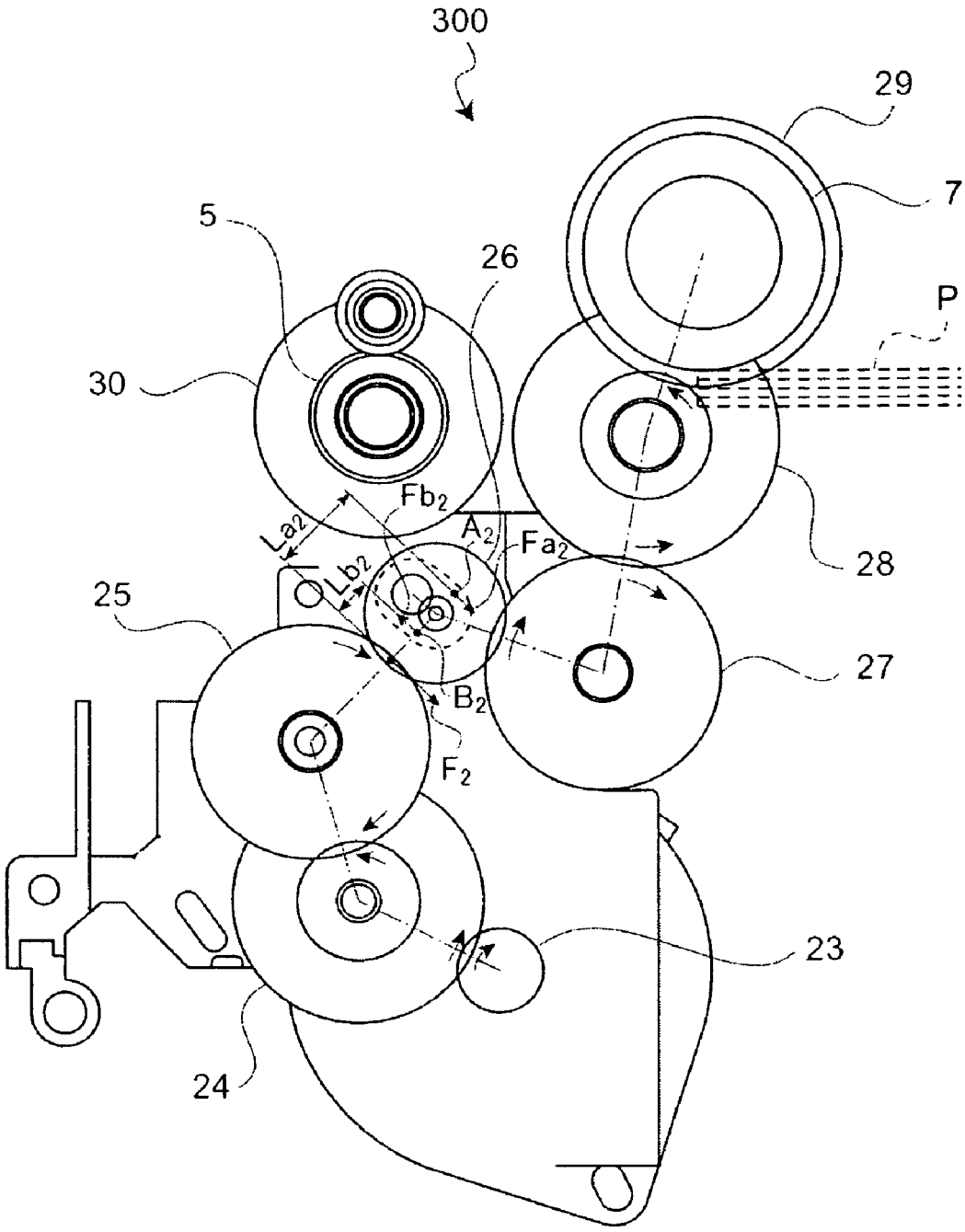
FIG. 4(A) is a schematic view showing a drive mechanism of a printer functioning as an MPT (Multi Purpose Tray) transportation mechanism according to a second embodiment of the present invention.
Figure 4B:
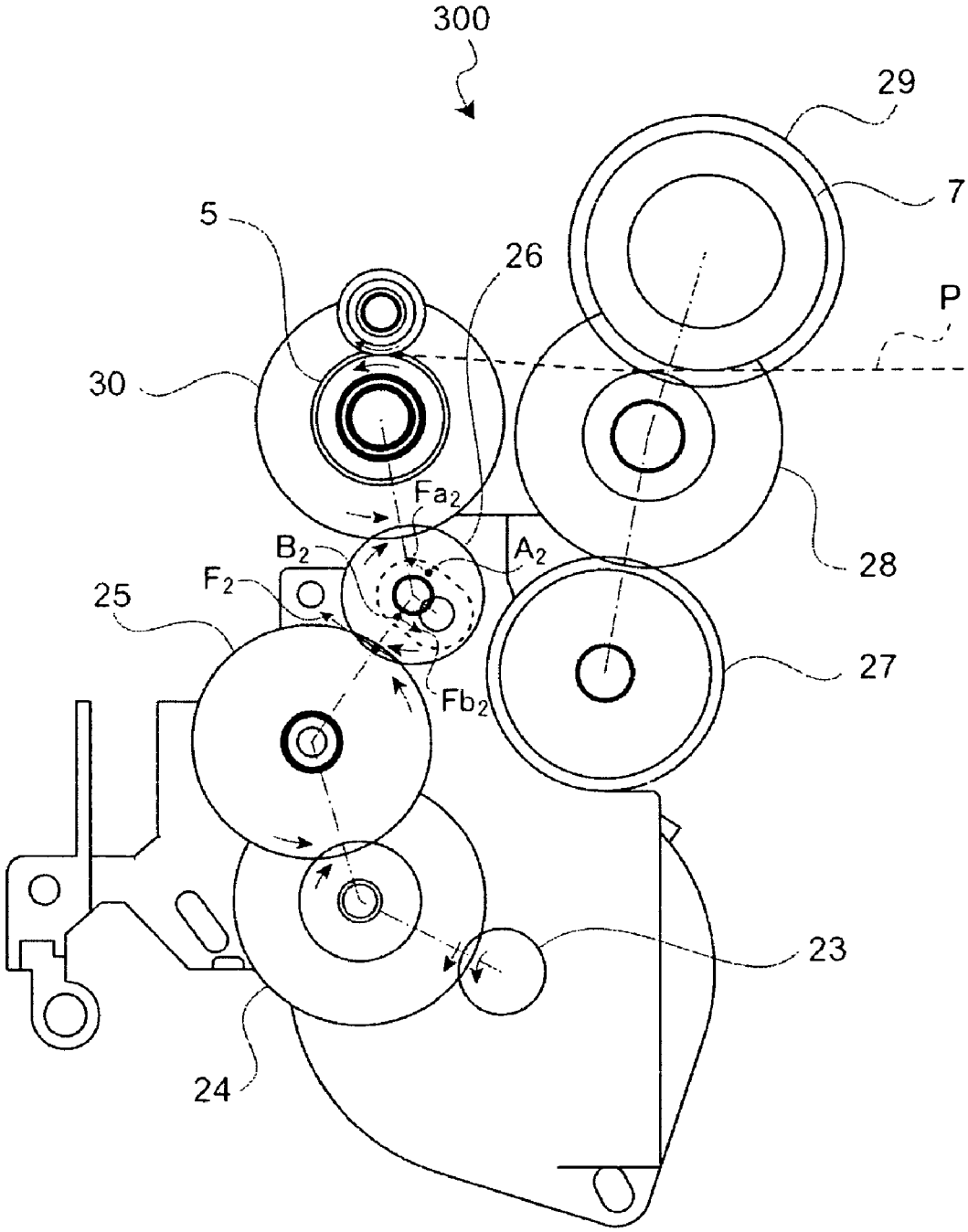
FIG. 4(B) is a schematic view showing the drive mechanism of the printer functioning as a medium transportation mechanism according to the second embodiment of the present invention.

FIG. 4(A) is a schematic view showing a drive mechanism 300 of the printer 100' functioning as the MPT (Multi Purpose Tray) transportation mechanism, in which the MPT sheet supply roller 7 transports the sheet P, according to the second embodiment of the present invention. FIG. 4(B) is a schematic view showing the drive mechanism 300 of the printer 100' functioning as the medium transportation mechanism, in which the register roller 5 transports the sheet P, according to the second embodiment of the present invention.

As shown in FIGS. 4(A) and 4(B), the drive mechanism 300 includes the drive source gear 23 for transmitting a drive force from a drive source (not shown); the reduction gear 24 engaging the drive source gear 23; the sun gear 25 engaging the reduction gear 24 and the planetary gear 26; the planetary gear 26 engaging one of the idle gear 27 of the MPT transportation mechanism and the register roller gear 30 of the medium transportation mechanism according to a rotational direction of the sun gear 25 for transmitting the drive force from the sun gear 25; the reduction gear 28 engaging the idle gear 27; and the MPT sheet supply roller gear 29 engaging the reduction gear 28. The sheet P placed in the MPT tray 6 is represented with a hidden line in FIG. 4(A).

Figure 5A:
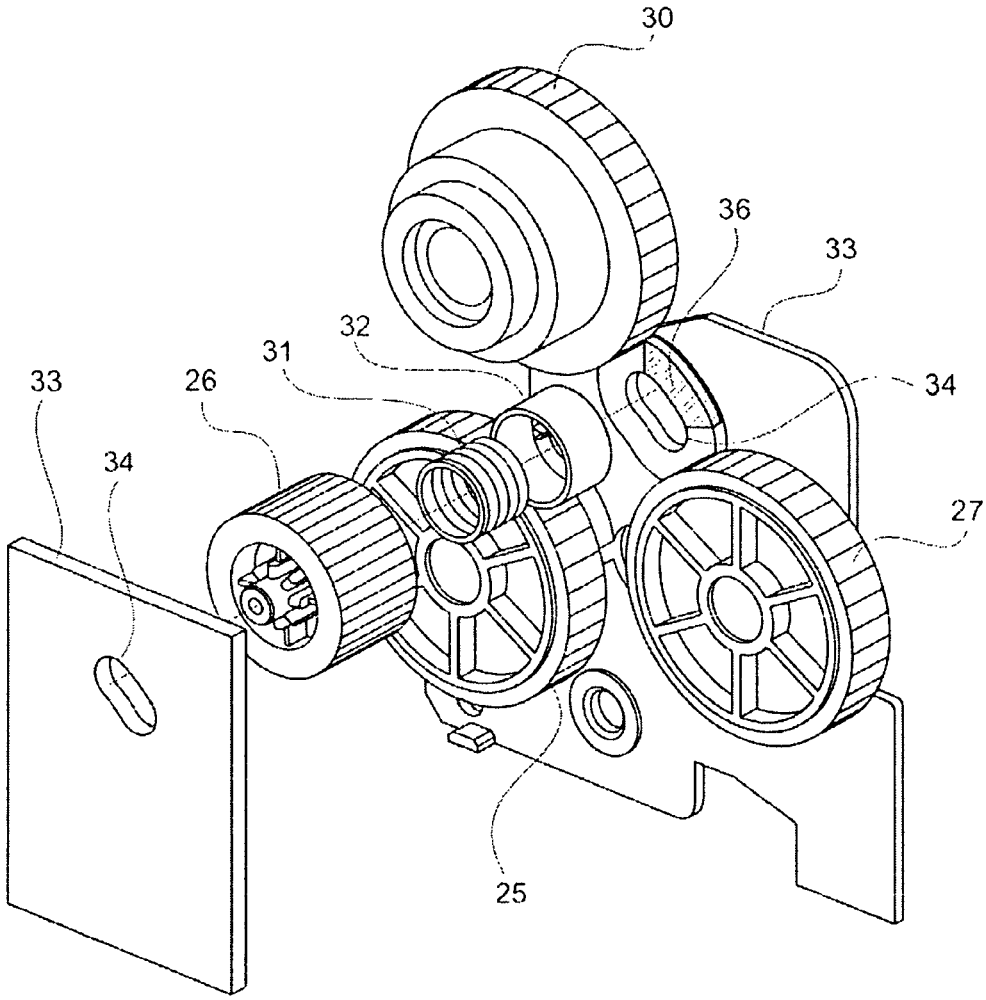
FIG. 5(A) is a schematic perspective view showing a configuration surrounding a planetary gear of the printer according to the second embodiment of the present invention.
Figure 5B:
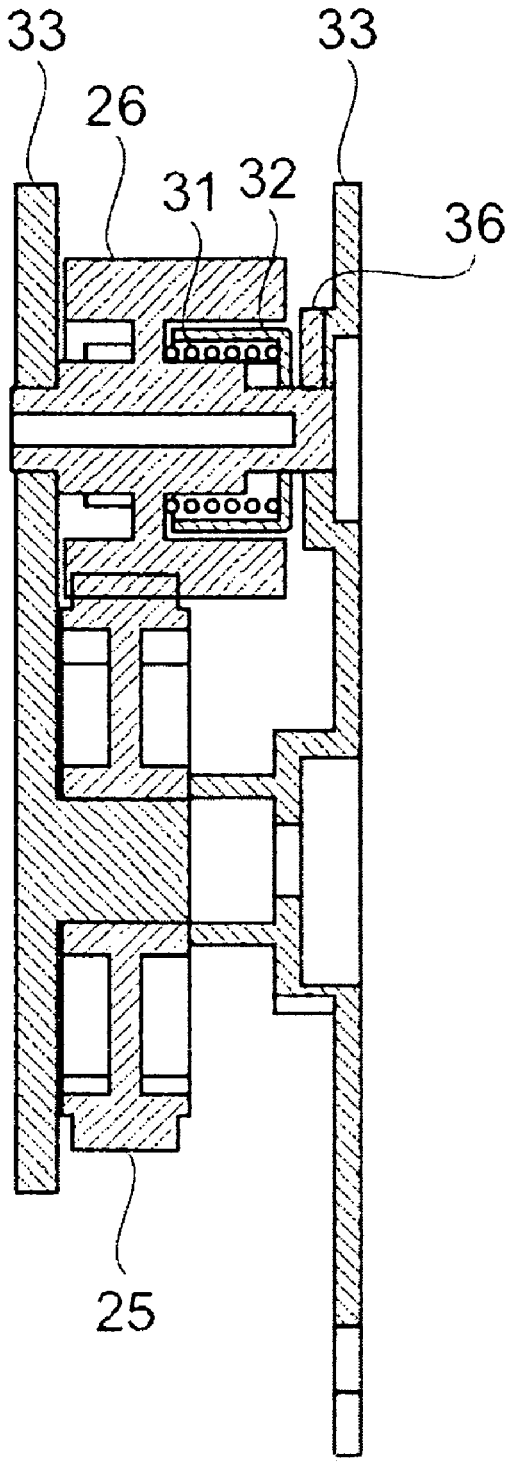
FIG. 5(B) is a schematic sectional view showing the configuration surrounding the planetary gear of the printer according to the second embodiment of the present invention.
Figure 6A:
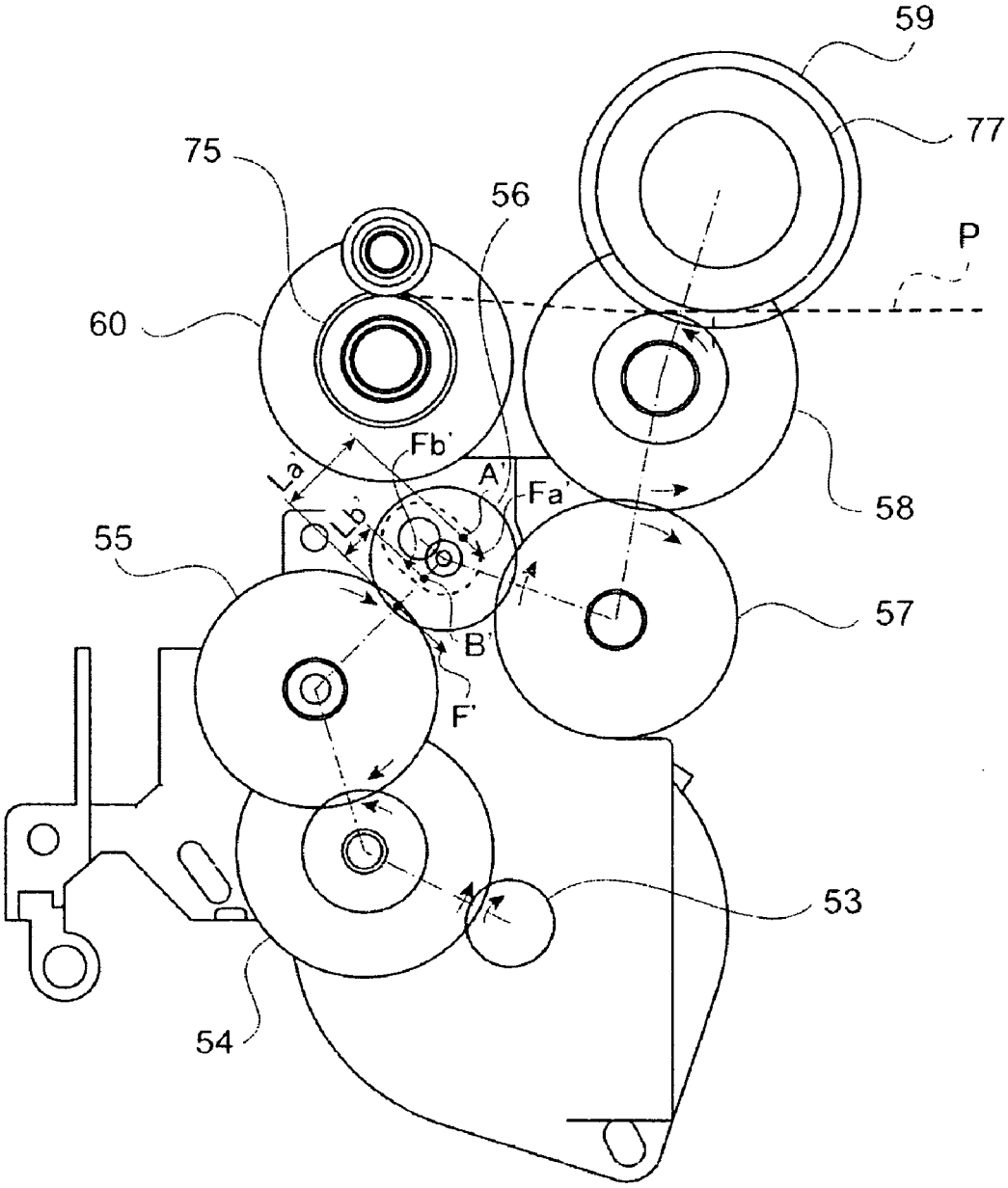
FIG. 6(A) CONVENTIONAL ART
FIG. 6(A) is a schematic view showing a configuration of a conventional medium transportation apparatus.
Figure 6B:
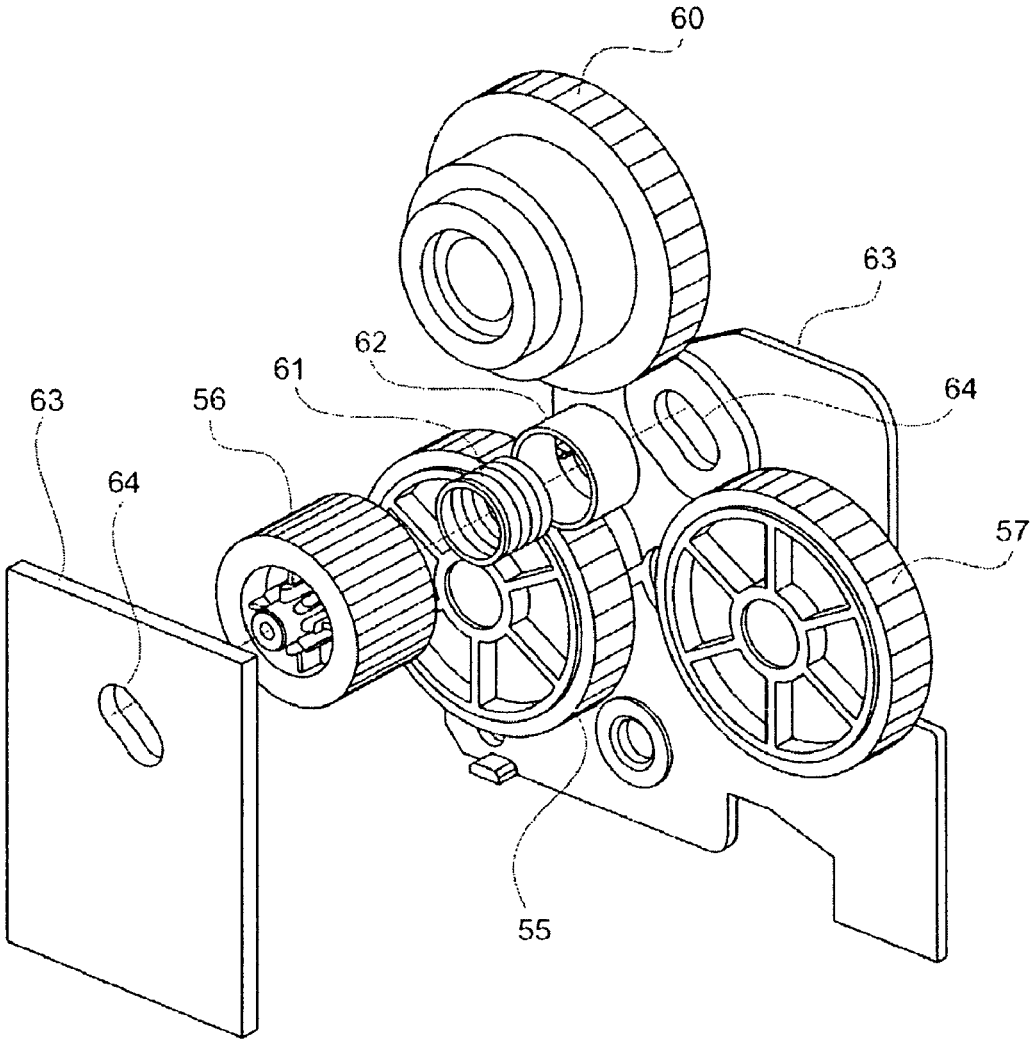
FIG. 6(B) CONVENTIONAL ART
FIG. 6(B) is a schematic perspective view showing a configuration surrounding a planetary gear of the conventional medium transportation apparatus.

FIG. 5(A) is a schematic perspective view showing a configuration surrounding the planetary gear 26 of the printer 100' according to the second embodiment of the present invention. FIG. 5(B) is a schematic sectional view showing the configuration surrounding the planetary gear 26 of the printer 100' according to the second embodiment of the present invention.

As shown in FIGS. 5(A) and 5(B), the pressing plate member 32 as the first rotational load member is disposed around the rotational shaft of the planetary gear 26 along the circumferential direction thereof. The compression spring 31 is disposed between the planetary gear 26 and the pressing plate member 32 for urging the pressing plate member 32 outwardly. The brackets 33 are arranged on both outsides of the planetary gear 26 and the pressing plate member 32, so that the brackets 33 sandwich the planetary gear 26 and the pressing plate member 32 with a specific distance therebetween.

In the embodiment, the compression spring 31 is disposed for urging the pressing plate member 32 outwardly. Accordingly, the reaction force of the brackets 33 is generated with respect to the pressing plate member 32 at the abutting positions between the pressing plate member 32 and the brackets 33. Further, each of the brackets 33 has the guide hole 34 with an arc shape for regulating a movement of the rotational shaft of the planetary gear 26. The guide holes 34 have a shape such that the planetary gear 26 engages the sun gear 25 and the idle gear 27 as shown in FIG. 4(A) when the rotational shaft of the planetary gear 26 moves to the right side. Further, the planetary gear 26 engages the sun gear 25 and the register roller gear 30 as shown in FIG. 4(B) when the rotational shaft of the planetary gear 26 moves to the left side.

In the embodiment, a high friction member 36 is disposed on one of the brackets 33 along a circumference of the guide hole 34. The high friction member 36 is arranged to slide against the pressing plate member 32 of the planetary gear 26 at a specific position outside relative to the rotational shaft of the planetary gear 26 in the radial direction of the rotational shaft of the sun gear 25. Further, the high friction member 36 is formed of a material with a high coefficient of friction such as a rubber foam having a hardness of 90°.

A printing operation of the printer 100' will be explained next. After the drive source (not shown) drives the sheet supply roller 2 to start rotating, the sheet supply roller 2 picks up the sheet P from the medium cassette 1 one by one. After the sheet supply roller 2 picks up the sheet P, the sheet P abuts against the feed roller 3 in a stationary state, so that the feed roller 3 warps the sheet P for a specific amount to correct skew thereof. After the drive source (not shown) drives the feed roller 3 to start rotating, the feed roller 3 transports the sheet P with skew thereof corrected to the register roller 5.

At this moment, the drive mechanism 300 has the arrangement shown in FIG. 4(B). More specifically, the drive source gear 23 rotates in the left direction, so that the sun gear 25 rotates in the left direction through the reduction gear 24 for transmitting the drive force of the right rotation to the planetary gear 26. At this moment, the rotational shaft of the planetary gear 26 moves in the guide holes 34 in the left direction. Accordingly, the planetary gear 26 engages the register roller gear 30, so that the drive force transmitted from the drive source gear 23 is transmitted through the reduction gear 24, the sun gear 25, the planetary gear 26, and the register roller gear 30 to rotate the register roller 5. When the register roller 5 starts rotating, the register roller 5 transports the sheet P transported from the feed roller 3 to the developing unit 10K.

In the next step, the LED array unit 9K irradiates the surface of the photosensitive drum 8K according to the print data at timing when the sheet P reaches the developing unit 10K, thereby forming the static latent image according to an image in black. The developing roller (not shown) attaches toner in black to the static latent image to inversely develop the static latent image, thereby forming the toner image in black.

When the sheet P reaches the nip portion between the photosensitive drum 8K and the transfer belt 11, the toner image in black on the photosensitive drum 8K is transferred to the sheet P through the bias voltage applied to the transfer roller 14*a*. Similarly, while the transfer belt 11 transports the sheet P, the toner images in other colors are sequentially transferred to the sheet P in the developing units 10Y, 10M, and 10C.

After the toner images are transferred to the sheet P, the sheet P is transported to the fixing unit 20. When the sheet P passes through the nip portion between the heat roller 16 and the fixing belt 18, the fixing unit 20 applies heat and pressure to the sheet P, thereby fixing the toner images to the sheet P. After the toner images are fixed to the sheet P, the medium discharge unit 21 discharges the sheet P to the medium stacker 22, thereby completing the printing operation.

When the sheet P is set in the MPT tray 6, and the MPT transportation mechanism transports the sheet P, the drive mechanism 300 has the arrangement shown in FIG. 4(A). In the arrangement, the drive source gear 23 rotates in the right direction, so that the sun gear 25 rotates in the right direction through the reduction gear 24 for transmitting the drive force of the left rotation to the planetary gear 26. More specifically, when the sun gear 25 rotates in the right direction, a force F2 is applied to a portion of the planetary gear 26 engaging the sun gear 25. As a rotational load of the planetary gear 26, frictional forces Fa2 and Fb2 are generated at points A2 and B2.

It is supposed that a distance between the engagement point between the planetary gear 26 and the sun gear 25 to the point A2 of the frictional force Fa2 is La2, and a distance between the engagement point to the point B2 of the frictional force Fb2 is Lb2. According to the moment relationship, when the following equation is satisfied, the rotational shaft of the planetary gear 26 moves the direction of the force F2 applied from the sun gear 25.

$$La2 \times Fa2 > Lb2 \times Fb2 \text{ or}$$

$$Fa2 > (Lb2/La2) \times Fb2 \quad (4)$$

The frictional force Fa2 is a product of a pressing force Pa2 of the compression spring 31 disposed in the planetary gear 26 at the point A2 and a coefficient of friction μa2 at the point A2 (Fa2=Pa2×μa2). Similarly, the frictional force Fb2 is a product of a pressing force Pb2 of the compression spring 31 disposed in the planetary gear 26 at the point B2 and a coefficient of friction μb2 at the point B2 (Fb2=Pb2×μb2). Accordingly, the equation (4) can be modified to the equation (5) as follows:

$$Pa2 \times \mu a2 > (Lb2/La2) \times Pb2 \times \mu b2 \quad (5)$$

In the embodiment, as described above, the high friction member 36 is disposed on one of the brackets 33 along the circumference of the guide hole 34. The high friction member 36 is arranged to slide against the pressing plate member 32 of the planetary gear 26. Accordingly, the coefficient of friction μa2 is greater than the coefficient of friction μb2 (μa2>μb2). As a result, a margin to satisfy the equation (5) increases. Accordingly, it is possible to securely move the rotational shaft of the planetary gear 26 in the direction of the force F applied from the sun gear 25 while rotating in the left direction.

When the rotational shaft of the planetary gear 26 moves in the guide holes 34 in the right direction, the planetary gear 26 engages the idle gear 27, so that the drive force transmitted from the drive source gear 23 is transmitted through the reduction gear 24, the sun gear 25, the planetary gear 26, the idle gear 27, the reduction gear 28, and the MPT sheet supply roller gear 29 to rotate the MPT sheet supply roller 7. When the MPT sheet supply roller 7 starts rotating, the MPT sheet supply roller 7 picks up the sheet P placed in the MPT tray 6 one by one.

After the MPT sheet supply roller 7 picks up the sheet P, the register sensor 4 detects the sheet P, and the sheet P abuts against the register roller 5. After a specific period of time from when the register sensor 4 detects the sheet P, the drive source gear 23 of the drive mechanism 300 starts rotating in an opposite direction, i.e., the left direction. According to the moment relationship described above, the rotational shaft of the planetary gear 26 moves in the guide holes 34 in the left direction, i.e., from the idle gear 27 in the MPT transportation mechanism to the register roller gear 30 in the medium transportation mechanism.

When the planetary gear 26 engages the register roller gear 30, the drive force transmitted from the drive source gear 23 is transmitted through the reduction gear 24, the sun gear 25, the planetary gear 26, and the register roller gear 30 to rotate the register roller 5. When the register roller 5 starts rotating, the register roller 5 transports the sheet P transported from the feed roller 3 to the developing unit 10K. Afterward, the developing unit 10K performs the image forming process as described above.

As described above, in the embodiment, the high friction member 36 is disposed on one of the brackets 33 along the circumference of the guide hole 34. The high friction member 36 is arranged to slide against the pressing plate member 32 of the planetary gear 26 at the specific position outside relative to the rotational shaft of the planetary gear 26 in the radial direction of the rotational shaft of the sun gear 25. Accordingly, it is possible to increase only the pressing force Pa2 generated at the point A2 with the compression spring 31. As a result, even when the reaction force generated on the circumference of the compression spring 31 for generating the pressing forces Pa2 and Pb2 varies, it is possible to securely move the planetary gear 26 in the direction of the force F2 applied from the sun gear 25.

In the embodiments described above, the electro-photography printer of the LED type is explained as an example, and the present invention is not limited thereto. The present invention is applicable to an electro-photography printer of an intermediate transfer type using a laser. Further, the present invention is applicable to a facsimile, a copier, and a multi-function product.

While the invention has been explained with reference to the specific embodiments of the invention, the explanation is illustrative and the invention is limited only by the appended claims.

What is claimed is:

1. A medium transportation apparatus, comprising:

a plurality of medium transportation units;

a drive source;

a sun gear connected to the drive source;

a planetary gear engaging the sun gear for transmitting a drive force to one of the medium transportation units according to a rotational direction of the sun gear; and a rotational load, member for applying a rotational load to the planetary gear, said rotational load member being disposed on an outer side relative to a rotational shaft of the planetary gear in a radial direction of a rotational shaft of the sun gear, wherein said rotational load member includes a first rotational load member disposed on one end portion of the rotational shaft of the planetary gear along a circumferential direction thereof and a stationary second rotational load member disposed on a bearing portion of the rotational shaft of the planetary gear, and said first rotational load member is arranged to slide against the second rotational load member at an edge surface thereof in an axial direction of the rotational shaft of the planetary gear to apply the rotational load to the planetary gear.

2. The medium transportation apparatus according to claim 1, wherein said second rotational load member includes a high friction member.

3. The medium transportation apparatus according to claim 1, wherein said first rotational load member includes an urging member and a pressing plate member.

4. The medium transportation apparatus according to claim 1, wherein said second rotational load member includes a protruding portion having a specific thickness.

5. The medium transportation apparatus according to claim 1, wherein said second rotational load member includes a component having the bearing portion.

6. The medium transportation apparatus according to claim 1, further comprising a supporting member for supporting the planetary gear, said second rotational load member including a protruding portion protruding from the supporting member toward the planetary gear.

7. The medium transportation apparatus according to claim 6, wherein said supporting member is arranged to support the planetary gear and the first rotational load member with a specific distance therebetween.

8. The medium transportation apparatus according to claim 7, wherein said second rotational load member includes the protruding portion to reduce the specific distance.

9. The medium transportation apparatus according to claim 8, wherein said second rotational load member includes the protruding portion protruding by a specific length in a rotational direction of the planetary gear.

10. An image forming apparatus comprising, a plurality of medium transportation units;

a drive source;

a sun gear connected to the drive source;

a planetary gear engaging the sun gear for transmitting a drive force to one of the medium transportation units according to a rotational direction of the sun gear; and a rotational load member for applying a rotational load to the planetary gear, said rotational load member being disposed on an outer side relative to a rotational shaft of the planetary gear in a radial direction of a rotational shaft of the sun gear, wherein said rotational load member includes a first rotational load member disposed on one end portion of the rotational shaft of the planetary gear along a circumferential direction thereof and a stationary second rotational load member disposed on a bearing portion of the rotational shaft of the planetary gear, and said first rotational load member is arranged to slide against the second rotational load member at an edge surface thereof in an axial direction of the rotational shaft of the planetary gear to apply the rotational load to the planetary gear.

11. The image forming apparatus according to claim 10, wherein said second rotational load member includes a component having the bearing portion.

12. The image forming apparatus according to claim 10, wherein said second rotational load member includes a high friction member.

13. The image forming apparatus according to claim 10, wherein said first rotational load member includes an urging member and a pressing plate member.

14. The image forming apparatus according to claim 10, wherein said second rotational load member includes a protruding portion having a specific thickness.

15. The image forming apparatus according to claim 10, further comprising a supporting member for supporting the planetary gear, said second rotational load member including a protruding portion protruding from the supporting member toward the planetary gear.

16. The image forming apparatus according to claim 15, wherein said supporting member is arranged to support the planetary gear and the first rotational load member with a specific distance therebetween.

17. The image forming apparatus according to claim 16, wherein said second rotational load member includes the protruding portion to reduce the specific distance.

18. The image forming apparatus according to claim 17, wherein said second rotational load member includes the protruding portion protruding by a specific length in a rotational direction of the planetary gear.

* * * * *